US006729807B1

(12) United States Patent
Spittle

(10) Patent No.: US 6,729,807 B1
(45) Date of Patent: May 4, 2004

(54) INTEGRAL LOFTY POLYMER GRID AND FIBER WEB MATRIX TURF REINFORCEMENT MATS

(75) Inventor: Kevin S. Spittle, Cornelius, NC (US)

(73) Assignee: Profile Products L.L.C., Buffalo Grove, IL (US)

( * ) Notice: Subject to any disclaimer, the term of this patent is extended or adjusted under 35 U.S.C. 154(b) by 0 days.

(21) Appl. No.: 10/289,922

(22) Filed: Nov. 7, 2002

(51) Int. Cl.[7] ..... B32B 7/02; E02D 17/20

(52) U.S. Cl. ..... 405/302.7; 47/56; 428/221; 428/411.1; 442/414; 442/415; 405/302.6

(58) Field of Search ..... 405/15, 16, 19, 405/24, 25, 302.4, 302.6, 302.7; 47/56; 428/221, 411.1, 200; 442/394, 414, 415

(56) References Cited

U.S. PATENT DOCUMENTS

| | | | | | |
|---|---|---|---|---|---|
| 2,092,183 | A | | 9/1937 | Rehfeld | 405/19 |
| 2,923,093 | A | * | 2/1960 | Allen | 47/56 |
| 3,517,514 | A | | 6/1970 | Visser | 405/19 |
| 4,002,034 | A | | 1/1977 | Muhring et al. | 405/19 |
| 4,364,197 | A | * | 12/1982 | Baron | 47/56 |
| 4,476,185 | A | * | 10/1984 | Spittle | 442/402 |
| 5,507,845 | A | * | 4/1996 | Molnar et al. | 405/302.7 |
| 5,741,832 | A | * | 4/1998 | Spittle | 47/56 |
| 5,779,782 | A | * | 7/1998 | Spittle | 47/9 |
| 5,849,645 | A | | 12/1998 | Lancaster | 442/5 |
| 5,942,029 | A | * | 8/1999 | Spittle | 47/9 |
| 6,135,672 | A | * | 10/2000 | Davidson | 405/302.6 |
| 6,156,682 | A | * | 12/2000 | Fletemier et al. | 442/394 |
| 6,349,499 | B1 | * | 2/2002 | Spittle | 47/9 |
| 6,351,911 | B1 | * | 3/2002 | Behrens | 47/56 |
| 6,360,478 | B1 | * | 3/2002 | Spittle | 47/9 |
| D456,224 | S | | 4/2002 | Lancaster | D8/1 |
| D456,674 | S | | 5/2002 | Lancaster | D8/1 |
| 6,635,329 | B1 | * | 10/2003 | Arndt et al. | 428/76 |
| 2003/0060113 | A1 | * | 3/2003 | Christie et al. | 442/364 |

* cited by examiner

*Primary Examiner*—Robert E. Pezzuto
*Assistant Examiner*—Tara L. Mayo
(74) *Attorney, Agent, or Firm*—Brooks Kushman P.C.

(57) ABSTRACT

A turf reinforcement mat (TRM) comprises a lofty polymer grid having integrally attached thereto a fibrous mat. The turf reinforcement mat is preferably produced by needle punching a fibrous mat containing low melt temperature thermoplastic fibers and a lofty polymer grid followed by heating to an elevated temperature to fuse fibers of the fibrous mat to strands of the lofty polymer grid. The integral TRM does not necessitate stitching to hold the various layers together in the integral product.

25 Claims, 2 Drawing Sheets

INTEGRAL LOFTY POLYMER GRID AND FIBER WEB MATRIX TURF REINFORCEMENT MATS

BACKGROUND OF THE INVENTION

1. Field of the Invention

The present invention pertains to turf reinforcement mats.

2. Background Art

Turf reinforcement mats ("TRM") are now in widespread use. TRM are used to protect the soil surface from severe erosion during high velocity, surface flow conditions, primary applications being channels, ditches, steep-long slopes and river bank stabilization. TRM vary in construction from loosely woven or non-woven plastic mesh to multiple layers of inorganic netting structures, loose filled with organic fibers, all stitched together. The use of plastic mesh or grid-like materials such as colbond, pyramat, enkabond, and others, provide little assistance in seed germination: their principal use is in providing reinforcement of the seed bed once seeds are germinated. By incorporation of such materials, the root systems are able to withstand much greater water velocity in overland flow, (water runoff) conditions. However the open nature of these products does little to reduce sediment and seed displacement prior to seed bed establishment.

Fiber mats have been used to assist seed germination and impair runoff. 100% organic blankets without the inorganic grid component aren't suitable for turf reinforcement applications. TRM products can take the place of rip rap or concrete for channel applications, an aesthetically attractive alternative while providing permanent long term protection to the channel.

Establishing seed beds in areas where high runoff is expected, i.e. on steep slopes, in gulleys, drainage channels, etc., has often required separate use of one or the aforementioned synthetic polymer grid-like materials and a separately applied fiber mat. Such a two-step approach is time and labor intensive, however, and has not been in widespread commercial use.

In U.S. Pat. No. 5,849,645, a complex composite mat having a heavy gauge bottom polymer grid, a heavy gauge top polymer grid, and a "cuspated" (pleated) "super heavy" gauge polymer netting are combined with a fiber matrix of coconut fibers to form a multilayer assembly which is stitched together to form an integral, multilayer composite structure. This product is widely used, and offers both runoff protection, assistance in seed germination, and protection against runoff in established seed beds. However, the product is expensive to manufacture and adds large quantities of substantially non-biodegradable materials to the soil due to its construction which necessarily contains three polymeric layers.

It would be desirable to provide a TRM product which offers runoff protection, assistance in germination, and protection against runoff in established seed beds, which introduces less synthetic polymer material into the soil and which can be inexpensively manufactured.

SUMMARY OF THE INVENTION

It has now been surprisingly discovered that a lofty synthetic polymer grid or non-woven can be economically combined with a fibrous mat to form a lofty TRM product. The polymer grid protrudes from at least one side of the composite product, and the product is installed with an exposed grid side toward the soil. In a particularly preferred embodiment, the fibrous mat contains minimally 5 weight percent of a low melt synthetic fiber and is thermally bonded to the lofty polymer grid.

DETAILED DESCRIPTION OF THE PREFERRED EMBODIMENTS

Figure 1A:
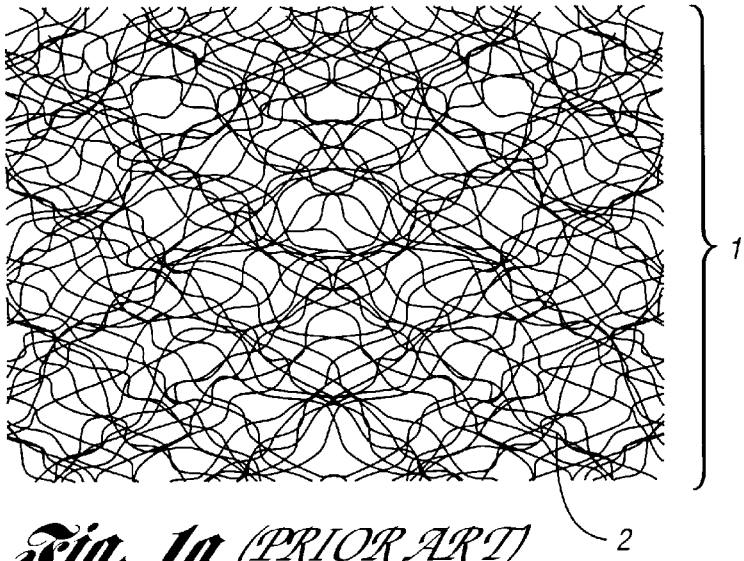
Fig. 1a (PRIOR ART)
FIG. 1*a* illustrates a lofty non-woven polymer grid which has been used to prevent runoff.
Figure 1B:
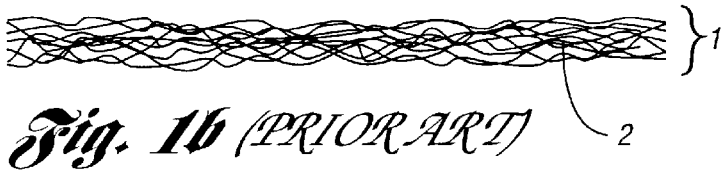
Fig. 1b (PRIOR ART)
FIG. 1*b* illustrates a side view of the product of FIG. 1*a* showing its lofty structure.

The polymer mesh, grid, or non-woven will be termed a "polymer grid" hereafter. Such polymer grids are a lofty product constructed of synthetic fiber strands or filaments which are intermeshed and optionally bonded together where the polymer strands cross over or abut. A preferred polymer grid 1 is shown in FIGS. 1*a* and 1*b* (Prior Art), and has been used alone or together with a separately applied fiber mat to maintain seed beds and prevent erosion, as described previously. Such lofty polymer grids are available from numerous sources, for example as COLBOND™ Geosynthetics and ENKAMAT™ three dimensional random polyamide matting, both available from Enka-Engineered Products, Enka, N.C., PYRAMAT™ turf reinforcement mat, available from Synthetic Industries, Inc., Chatanooga, Tenn., and TENAX™ Geomat, available from Tenax U.K. Limited, Wrexham, U.K., among others.

The polymer strands 2 of the lofty polymer grid 1 are generally a single rather thick polymer filament which is kinked during extrusion or during fabrication of the material to provide a three-dimensional (i.e., lofty) product. The polymer is generally one resistant to ultraviolet light ("U.V."), and many be of polyamide, polyolefin, polyester, or any suitable thermoplastic. Some polymers, particularly polyolefins, require incorporation of U.V. protection agents, as is well known to the art. The polymer may be pigmented or contain suitable dyes or colorants if desired.

The fibrous mat of the present invention may comprise but a single layer of fibers, if desired, or multiple layers of the same or different construction may be used. A single fibrous mat is preferred.

Since in preferred embodiments the fibrous mat must be thermally bonded to the lofty polymer grid, it is necessary that the fibrous mat contain or be treated to contain a binder or binding agent in these embodiments. In the preferred embodiment, the fibrous mat contains sufficient polymer fiber of low melt temperature to bond to the strands of the lofty polymer grid so as to form an integral structure without the need for stitching the layers together as taught by U.S. Pat. No. 5,849,645, and without requiring a separate binder. The melting point of the low melt temperature fibers is low enough to bond to the lofty polymer grid without causing the latter to melt and/or deform appreciably. Thus, the melting point will be lower than the melt temperature of the material of the lofty polymer grid, preferably at least 20° C. lower, and more preferably 40° C. or more lower. A melting point in the range of 80° C. to 180° C. is preferable for the low melt temperature fibers, more preferably 90° C. to 150° C., and most preferably 100° C. to 130° C.

The low melt temperature fibers may comprise polyethylene or polyethylene oligomers, for example, polymers with a melting point below 130° C., preferably about 110° C. The low melt temperature fiber generally comprises minimally 3 weight percent of the fibrous mat, more preferably 10 to 40 weight percent, and most preferably 10 to 25 weight percent. The entire fibrous mat may comprise low melt temperature fiber, but this is not preferred.

The low melt temperature fibers are preferably bicomponent fibers prepared by coextruding two polymers of different melt temperature together. One portion of the fiber is a low melt thermoplastic while another portion has a higher melting point. The fibers may be extruded with the two different thermoplastics substantially adjacent each other, or may be in the form of a core/sheath fiber, with the core of the higher melt temperature fiber. The latter core/sheath structure is highly preferred. An example of a core/sheath bicomponent fiber is one with a polyester core and a polypropylene sheath. A suitable bicomponent fiber is low melt sheath polyester available from Intercontinental. The amount of bicomponent fibers is, in general, somewhat higher than the amount of single component fibers of low melt temperature, since it is the low melting component which binds the composite structure together. The fibrous mat must contain an effective amount to bond to the lofty polymer grid to produce an integral structure, in general at least 5% by weight, more preferably 10% by weight or more, and most preferably 15 weight percent or more. The fibrous mat may constitute up to 100% bicomponent fibers.

In addition to the low melt temperature fibers, the fibrous mat preferably contains other fibers as well. In embodiments not requiring low melt temperature fibers, these "other" fibers will form the largest part or all of the fibrous mat. These fibers may be synthetic polymer fibers or natural fibers. The mat may also contain a small proportion of comminuted paper such as is contained in sprayable mulch products, although this is not desired.

Useful synthetic fibers include fibers which do not have a low melt temperature in the sense previously described, and thus in general will not fuse to the lofty polymer grid. These fibers may be straight or kinked, and may be in the form of single fibers, bundles of fibers, yarns, tows, or any mixture thereof. The material of the fibers may be any conventional polymer, including without limitation, rayon, cellulose acetate, cellulose nitrate, polyester, polyamide, polyaramide, polyvinyl acetate, polyurethane, polyacrylamide, poly (meth)acrylate, etc. Crimped fibers are particularly useful, as these aid in the entanglement of the fibers in the fibrous mat. In non-bonded needled products as described hereinafter, low melt temperature fibers may be used as well, but are not thermally fused to bond the composite together.

The additional natural fibers are prepared from naturally occurring sources, with or without additional chemical modification of the fibers, particularly, with partial digestion with steam or hot water. Such naturally occurring fibers are well known, and may include, without limitation, fibers of wood, hemp, jute, coconut, sisal, flax, corn stalks or leaves, straw, etc. Wood fibers are preferred.

Figure 2A:
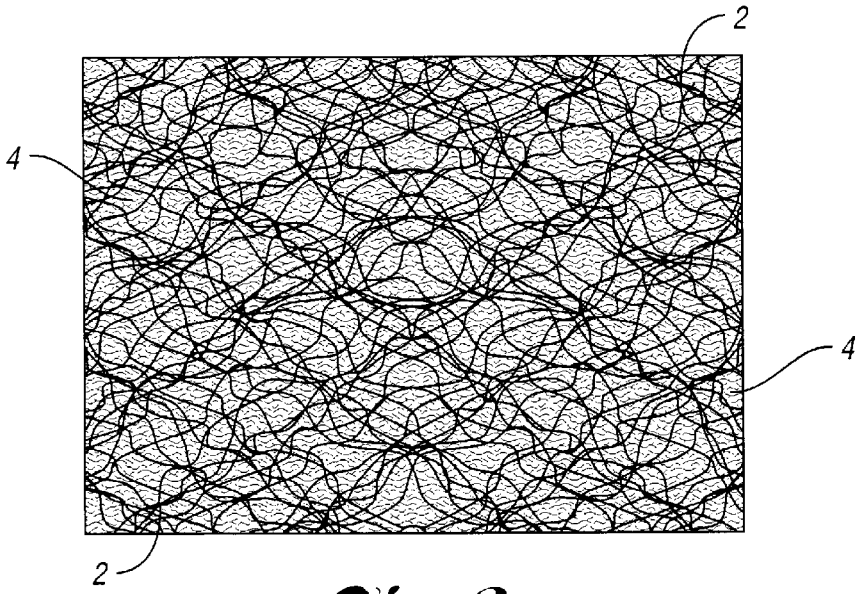
FIG. 2*a* illustrates a needle punched TRM as shown from the top.
Figure 2B:
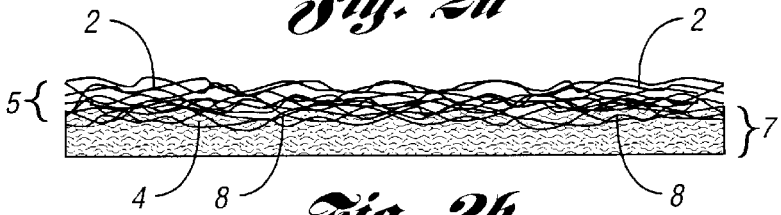
FIG. 2*b* illustrates a needle punched TRM viewed from the side.
Figure 7:
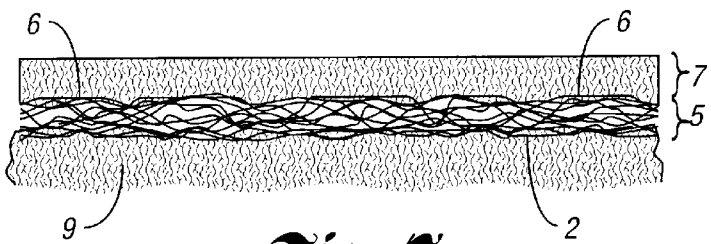
FIG. 7 illustrates a TRM of the subject invention applied to seed bed.

A preferred embodiment of the subject invention is illustrated in FIGS. 2*a* and 2*b*, where the strands 2 of a lofty polymer grid 5 (FIGS. 1*a*, 1*b*) are entangled with and thermally bonded to fibrous mat 7 containing fibers 4. It is noted that some strands 8 lie within the mat 7. FIG. 7 illustrates a TRM such as one of FIGS. 2*a*, 2*b*, and 3, positioned on soil 9.

The fibrous mat may be prepared by any suitable technique. Preferred are wet and dry laying of the mat, both processes well known to those skilled in the art. In wet laying, the fibers are suspended in water and laid atop a screen through which water escapes, leaving a damp mat. This process is widely used in paper making. In dry laying, the fibers are suspended in an air stream and deposited on a screen or belt. Any process which enables a suitable mat may be employed. The dry thickness of the mat may be any thickness which provides a web handleable to produce the final product and provide the desired seed germination assistance and water diversion properties. Prior to any needling operations, the mat may range in thickness from about 1/50 inch to about ½ inch, more preferably 1/32 inch to ¼ inch, and most preferably 1/16 inch to ¼ inch.

In the laying process, a binding agent may optionally be employed, and in certain embodiments, is necessary. In the dry process, for example, particulate binders such as redispersible polymer powders, preferably polyvinylacetate, ethylenevinylacetate, or vinylacetate/alkylacrylate copolymers, may be employed. Many other thermoplastic and thermosettable binders are suitable. Following laying of the mat, it is exposed to elevated temperature to activate the dry binder if necessary. In both the wet and dry laying processes, a separate dry binder may be sprayed onto the previously laid web.

Figure 3:
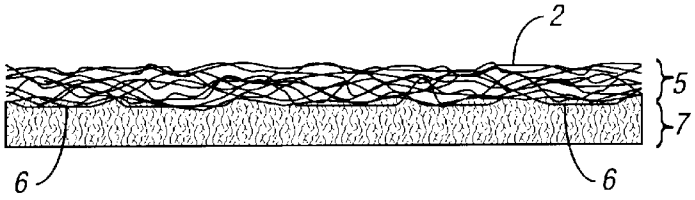
FIG. 3 illustrates a contact bonded TRM of the subject invention.

In preferred embodiments, the fibrous web containing low melt temperature fibers and/or binder and the lofty polymer grid are then contacted an bonded together. Alternatively, the polymer grid and fibrous mat may be contacted or "married," following which binder, in dry particulate form, in aqueous dispersion, or in solution, may be applied. Since only a small proportion of the strands of the lofty polymer grid will contact the mat due to the former's lofty nature, thermal bonding by contact with only the fibrous mat surface may not result in a structurally integral product, although this method may be suitable with specially fabricated grids having substantial filaments on a bottom plane which can contact the mat, or with fibrous mats with a high proportion of low melt fibers or binder. A test of the degree of bonding is whether there is any substantial separation of the mat from the grid during normal handling and installation. It is generally satisfactory that the grid may be separated from the mat by purposefully pulling the layers apart by exerting modest tension between the layers. A contact bonded TRM is shown in FIG. 3 from the side, where bottommost strands 6 of the lofty grid 5 are thermally bonded to the mat 7.

A TRM which is resistant to separation of the fibrous mat and lofty polymer grid in the manner described, without requiring stitching to maintain integrity, may be termed an "integral TRM." However, it would not depart from the spirit of the invention to additionally stitch the integral TRM, provided that the product without stitching meets the requirements for an integral TRM. However, it is more appropriate to produce a bonded composite product where separation of the lofty polymer grid from the fibrous mat is quite difficult if not impossible, without destroying the various components. Such structural integrity is made possible by a construction wherein the strands or filaments of the lofty polymer grid penetrate into the fibrous mat. Such penetration may be accomplished in numerous ways. Two preferred methods of penetration include entanglement by needle punching and entanglement during the mat laying process.

In needle punching, which is presently preferred, the separate lofty fiber grid and fibrous mat are contacted, preferably in continuous fashion, and entanglement of the grid strands into the mat is accomplished by directing the adjacent layer through a needle board. The latter consists of a single line of posts or needles, preferably barbed, or an array of the latter, which is caused to rise and lower repeatedly into and out of the TRM layers. Such needle punching is well known, and is used, for example, to prepare felts and other fabrics, and lofty glass mats suitable for use in glass mat-reinforced thermoplastic ("GMT") products.

Figure 4:
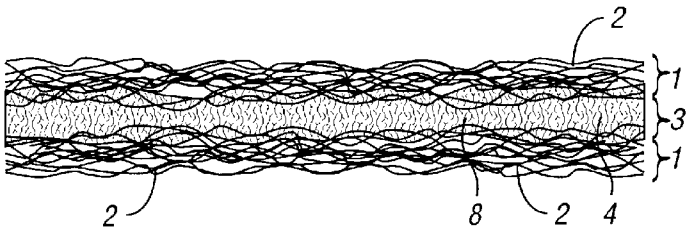
FIG. 4 illustrates a TRM having two needle punched lofty polymer grids sandwiching a single fibrous mat.

The needle board may be equipped with barbed needles, with flat headed needles, with posts in lieu of needles, or any type of extension which will force some of the lofty polymer grid strands into the fibrous mat, or cause fibers from the fibrous mat to be entangled with the polymer grid strands. Such a product is illustrated in FIG. 2*b*, where strands 2 of the polymer grid are in intimate contact with fibers 4 of the fibrous mat 3 at locations 8. Following needle punching, in preferred embodiments, the composite web is subjected to elevated temperature to bond the web to the polymer grid, for example at a temperature of 140° C. The needle punching process has the advantages that it is simple and economical and involves a process well known in fabric production; that the degree of entanglement can be easily adjusted; that the process can be used with multiple layers of fibrous mats and/or multiple polymer grids sandwiching fibrous mats as shown in side view in FIG. 4.; and that the structural integrity of the needled and bonded TRM is very high.

An alternative method of preparing the TRM of the subject invention is laying up the fibrous mat directly onto or into the lofty polymer grid by wet laying or dry laying processes. For example, in wet laying, the lofty polymer grid is positioned atop a fiber retaining screen and the aqueous suspension of fibers applied from the top. The fibers form a mat toward the screen surface, with fibers being entangled during the laying process within the strands of the lofty polymer grid. The assembly is then dried and heated to bond the lofty polymer grid to the mat. Air laying is similar, but employs air rather than water as a suspending medium for the fibers.

A useful variant of the above process is to air or wet lay a fibrous mat onto and/or within a lofty polymer grid as previously described. In this variant embodiment, however, the low melt temperature fibers may be dispensed with provided that they are replaced by a particulate thermoplastic or thermoset adhesive or by a soluble resin adhesive, which is then cured, if necessary at elevated temperature, to bond the fibers of the fibrous mat to the lofty polymer grid.

When more than one fibrous mat is employed, the mats may be of the same or of different composition. When at least two fibrous mats are employed, it is only necessary that one mat contain low melt temperature fibers or binder, this mat positioned so as to sandwich the fibrous mat containing no low melt fibers or binder. When two polymer grids are employed, the grids should preferably be positioned on opposite sides of the fiber mat(s).

Figure 5:
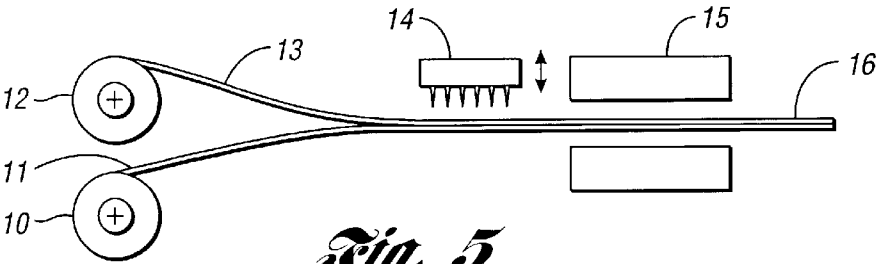
FIG. 5 illustrates one embodiment of a needle punching TRM fabrication process.

The preferred needle punching process is shown schematically in FIG. 5. In FIG. 5, a roll 10 supplies fibrous mat 11 while a roll 12 supplies lofty polymer grid 13, the two are allowed to contact each other, and are entangled by needle board 14, following which they are bonded by heat source 15 to produce the integral TRM product 16. The heat source 15 may be a hot air oven, a microwave oven, or heat lamps, so long as the low melt temperature fibers or binding agent, when used, is raised to a sufficient temperature to bond the components together. A hot air oven is preferred. The fiber mat 11 may be preformed in the same or different location and supplied in roll form (as shown) or in folded configuration, or may be continuously produced in an air-laying or wet-laying process and conveyed to the needle punching station.

Figure 6:
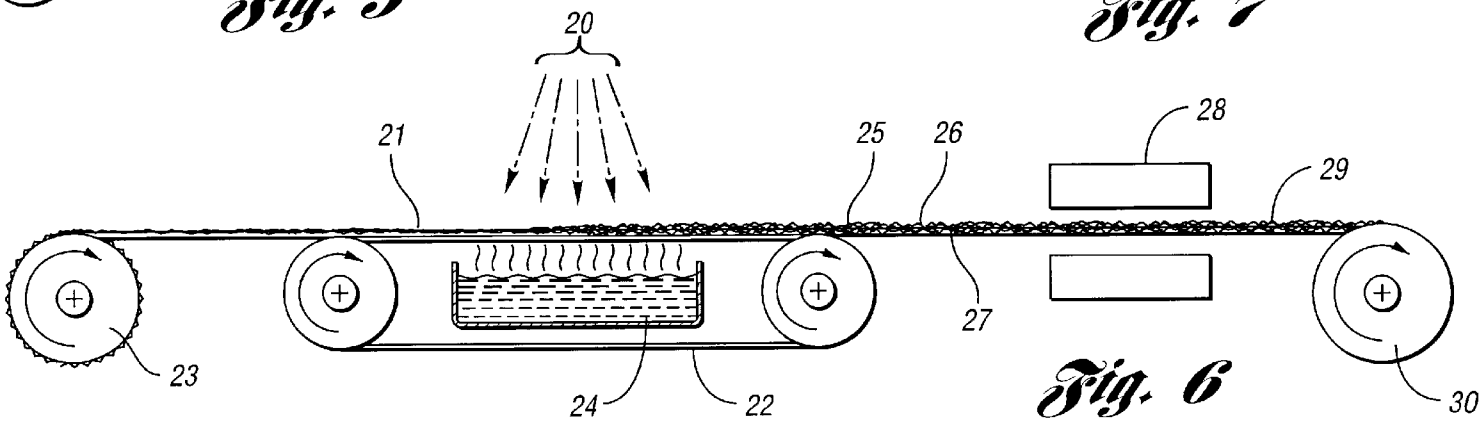
FIG. 6 illustrates one embodiment of a fabrication process not employing needle punching.

FIG. 6 illustrates a wet-laying process. In FIG. 6, a suspension 20 of fibers, is supplied to a layer of lofty polymer grid 21 which lies atop a continuous screen 22, the polymer grid supplied by roll 23. Water from the fiber suspension flows through the screen to tank 24, leaving the fibers behind on the screen and entangled with the polymer grid. The initial product 25 thus consists of polymer grid 26 entangled with fiber mat 27. This product then is subjected to elevated temperature, for example in oven 28 to produce an integral TRM product 29 which may be taken up on roll 30. The intermediate product may optionally be needle punched to provide further entanglement prior to bonding.

In a yet further embodiment, the fibrous mat further contains continuous or intermediate length fibers, for example but not by way of limitation, having average fiber lengths of 2 to 3 cm. or longer, and the fibrous mat is primarily attached to the lofty polymer grid by needle punching with barbed needles, which thoroughly entangle fibers of the fibrous mat with strands of the lofty polymer grid. The long fibers may be supplied in forming the web as a series of overlapping circles of strands of fiber, such as is used to form GMT intermediate products. Use of at least some continuous fibers is preferred. The needle punching operation breaks many of the strands but entangles others, producing a product where thorough entanglement produces a product wherein the polymer grid is virtually impossible to separate from the fibrous mat. Wood and other natural fibers are integrated at the same time. In this embodiment, no low melt thermoplastic fibers or binding agents need be used. The entanglement and length of the fibers employed must be such that the overland flow velocity will not remove the fibers in substantial amount. At the same time, the fibers must not be packed so densely that seed emergence is reduced significantly.

The advantages of the composite TRM of the subject invention are many. Unlike the complex multilayer structure of U.S. Pat. No. 5,849,645, requiring numerous steps during the preparation, including production of a "super heavy" pleated central portion, and stitching the various layers together, the subject invention product, in its simplest form, requires but two layers, each produced by well known processes, which are married together into an integral structure in a simple process. The product may be inexpensively produced, and may be cut, for example, without the possibility of stitching unraveling, thus rendering separation of the layers in the field less likely. The product may also be produced with much lower content of thermoplastic, thus being more environmentally friendly, even though the polymer content is generally desired to be permanent, as would be required for TRM which meet industry description of "Permanent Turf Reinforcement Mats."

The fibrous mat is preferably of a thickness, after needle punching when the latter is used, of from about ⅛ inch to ¾ inch, preferably about ⅜ inch, which, when exposed to heavy rain or irrigation, breaks up the streams of water impinging upon the TRM and drastically lowers the ability of the raindrops to dislodge sediment. Because the layers are intimately entangled and, in preferred embodiments, bonded, the product is easy to handle and may be laid down on the ground in but a single operation. The product is thus economical in application as it is also in production.

The fibrous mat also aids in retention of sediment, and assists seeds in germinating by retention of moisture within the mat and shielding the soil from direct contact with both sunlight and the atmosphere, which both bring about evaporation of water from the ground.

EXAMPLE 1

A lofty COLBOND™ Geosynthetic polymer grid from Enka-Engineered Products is married to a fibrous web composed of 15 weight percent low melt sheath polyester bicomponent fibers having a low melt temperature thermoplastic sheath and a high melt temperature thermoplastic core, available from Intercontinental, and 85 weight percent wood fiber. The mat has a nominal 1/16 inch thickness. The married layers are needle punched to entangle the fibers and subsequently heated in an oven to bond the bicomponent fibers to the strands of the lofty polymer grid. An integral product wherein the fibrous mat and polymer grid are impossible to separate without substantially destroying the TRM is produced. As a result of the needle punching, the ultimate thickness of the fiber mat is greater than 1/16 inch.

EXAMPLE 2

A lofty polymer grid of COLBOND™ Geosynthetic polymer grid is supplied on a belt and a dry mixture of fibers including 15 weight percent bicomponent fibers is supplied in an air stream and allowed to settle within the interstices of the lofty polymer grid. Settling is encouraged by a modest vacuum applied to the reverse side of the belt, which is perforated with numerous openings. The product traverses an oven which bonds the bicomponent fibers to strands of the lofty polymer grid. An integral TRM with fibers of a fibrous mat entangled with and bonded to strands of the lofty polymer grid is produced.

EXAMPLE 3

Example 2 is repeated, except that in lieu of bicomponent fibers, the dry fiber mixture constitutes 90% by weight wood fibers and 10% by weight of a pulverulent polyvinylacetate/ethylene copolymer adhesive. Upon passing through the oven, the particulate adhesive melts, bonding wood fibers to strands of the polymer grid. A TRM product having wood fibers entangled within and bonded to strands of the lofty polymer grid is produced.

EXAMPLE 4

The process of Example 1 is followed, but two layers of lofty polymer grid are supplied, one on each side of the fibrous mat. After needle punching and thermal bonding, an integral TRM is prepared which is substantially symmetrical, either side of which may be installed against the earth.

EXAMPLE 5

A fibrous mat is prepared by air-laying a ⅜ inch layer of wood fibers and crimped synthetic fibers. The initially formed mat passes under a distribution head which lays down multiple strands of continuous synthetic fiber, each strand comprising numerous filaments. The strands are laid down as overlapping circles, and constitute about 30 weight percent of the total intermediate fiber web. A layer of COLBOND™ Geosynthetic polymer grid is laid atop the fibrous mat and exposed to needle punching with barbed needles. The needle punching operation thoroughly entangles fibers of the fibrous web with strands of the polymer grid to produce an integral product without requiring bonding at elevated temperature.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A turf reinforcement mat ("TRM") comprising at least one lofty polymer grid and at least one fibrous mat, fibers of said fibrous mat bonded to strands of said lofty polymer grid, or entangled with strands of said lofty polymer grid to produce an integral TRM, said lofty polymer grid extending outwards from at least one exterior surface of said integral TRM.

2. The TRM of claim 1, wherein fibers of said fibrous mat are entangled within strands of said lofty polymer grid.

3. The TRM of claim 2, wherein said fibrous mat contains 3 weight percent or more based on the weight of the fibrous mat of low melt temperature fibers having a melt temperature below the melt temperature of strands of the lofty polymer grid.

4. The TRM of claim 3, wherein said low melt temperature fibers are bicomponent fibers.

5. The TRM of claim 4, wherein said fibrous mat contains minimally 5 weight percent of bicomponent fibers.

6. The TRM of claim 1, prepared by the steps of:

a) supplying a fibrous mat containing a fusible thermoplastic;

b) supplying a lofty polymer grid;

c) contacting said fibrous mat with said lofty polymer grid;

d) needle punching said fibrous mat and said lofty polymer grid to entangle fibers of said fibrous mat and strands of said lofty polymer grid to form an entangled intermediate product; and e) heating said entangled intermediate product to bond fibers of said fibrous mat to strands of said lofty polymer grid.

7. The TRM of claim 6, wherein said fusible thermoplastic comprises low melt temperature thermoplastic fibers.

8. The TRM of claim 7, wherein said low melt temperature thermoplastic fibers comprise bicomponent fibers.

9. The TRM of claim 6, wherein said fusible thermoplastic comprises a particulate thermoplastic adhesive.

10. The TRM of claim 1, prepared by the process comprising:

a) supplying a lofty polymer grid;

b) supplying a mixture of fibers to said lofty polymer grid such that a fibrous mat is formed within said lofty polymer grid; and c) bonding fibers of said fibrous mat to strands of said lofty polymer grid.

11. The TRM of claim 10, wherein said mixture of fibers contain minimally 3 weight percent of low melt temperature thermoplastic fibers, and said step of bonding comprises heating said lofty polymer grid and fibrous mat within said lofty polymer grid to fuse fibers of said fibrous mat to strands of said lofty polymer grid.

12. The TRM of claim 11, wherein said low melt temperature thermoplastic fibers comprise bicomponent fibers.

13. The TRM of claim 11, wherein said fiber mixture is supplied as a dry fiber mixture in an air-laying process.

14. The TRM of claim 11, wherein said fiber mixture is supplied as an aqueous suspension in a wet-laying process.

15. The TRM of claim 10, wherein said mixture of fibers further comprises a particulate thermoplastic or particulate thermosetting adhesive, and bonding is accomplished by heating said lofty polymer grid and said fibrous mat.

16. A process for the preparation of a TRM of claim 1, comprising:

a) supplying at least one lofty polymer grid;

b) juxtaposing on said at least one polymer grid at least one fibrous mat;

c) needle punching said fibrous mat and said lofty polymer grid to entangle fibers of said fibrous mat with strands of said lofty polymer grid; and d) when said fibrous mat contains low melt temperature fibers and/or a thermoplastic or thermosetting adhesive, heating the product obtained in step c) to bond fibers of said fibrous mat to strands of said lofty polymer grid.

17. The process of claim 16, wherein said fibrous mat comprises continuous fibers or fibers of intermediate length, and said needle punching comprises needle punching with barbed needles, such that an integral product is prepared without a heating step.

18. The process of claim 16, wherein said fibrous mat contains minimally 3 weight percent of low melt temperature thermoplastic fibers and step d) is practiced.

19. The process of claim 18, wherein said low melt temperature fibers comprise bicomponent fibers.

20. The process of claim 16, wherein said fibrous mat contains a solid, particulate adhesive activatable at an elevated temperature and step d) is practiced.

21. A process for the preparation of a TRM of claim 1 comprising:

a) providing a lofty polymer grid;

b) contacting said lofty polymer grid with a suspension of fibers in an air-laying or a wet-laying process to form a fibrous mat within said polymer grid and entangled with strands of said polymer grid to form an intermediate product;

wherein fibers of said fibrous mat are bonded to strands of said lofty polymer grid by one or more of the following:

i) fibers of said fibrous mat include low melt thermoplastic fibers, and the product of step b) is heated to bond fibers of said fibrous mat to strands of said lofty polymer grid, ii) a pulverulent thermoplastic or thermoset adhesive is supplied together with said suspension of fibers in a dry laying process and cured to bind fibers of said fibrous mat to strands of said lofty polymer grid, iii) to a dried intermediate product of step b) is applied a pulverulent thermoplastic or thermoset adhesive which is cured to bond fibers of said fibrous mat to strands of said lofty polymer grid.

22. The process of claim 21, wherein a pulverulent thermoplastic adhesive is supplied together with said suspension of fibers in an air-laying process and heated to melt said thermoplastic adhesive.

23. The process of claim 21, wherein a thermosetting adhesive is employed.

24. The process of claim 23, wherein said thermosetting adhesive is cured at an elevated temperature.

25. A process for reinforcing a seed bed against runoff, said process comprising applying to said seed bed the TRM of claim 1, with an extending polymer grid surface of said TRM installed adjacent said seed bed.

* * * * *